US012123179B2

(12) United States Patent
Huang et al.

(10) Patent No.: US 12,123,179 B2
(45) Date of Patent: Oct. 22, 2024

(54) EASILY-MOUNTED PULL-OUT FAUCET

(71) Applicant: Yongqiang Yan, Fujian (CN)

(72) Inventors: Lengjie Huang, Fujian (CN); Pingqing Zhang, Xiamen (CN); Haihua Su, Fujian (CN); Changzheng Ni, Xiamen (CN)

(73) Assignee: Yongqiang Yan, Xiamen (CN)

( * ) Notice: Subject to any disclaimer, the term of this patent is extended or adjusted under 35 U.S.C. 154(b) by 97 days.

(21) Appl. No.: 17/682,975

(22) Filed: Feb. 28, 2022

(65) Prior Publication Data

US 2023/0193601 A1 Jun. 22, 2023

(30) Foreign Application Priority Data

Dec. 17, 2021 (CN) ..... 202123197219.X

(51) Int. Cl.
*E03C 1/04* (2006.01)

(52) U.S. Cl.
CPC ..... *E03C 1/0401* (2013.01); *E03C 1/0403* (2013.01); *E03C 2001/0415* (2013.01)

(58) Field of Classification Search
CPC ..... E03C 2001/0415
See application file for complete search history.

(56) References Cited

U.S. PATENT DOCUMENTS 4,281,857 A * 8/1981 Randall ..... F16L 5/02 411/433
5,010,922 A * 4/1991 Agresta ..... E03C 1/102 137/359
9,212,474 B2 * 12/2015 Ye ..... E03C 1/0401
9,222,245 B2 * 12/2015 Ye ..... E03C 1/04
11,208,791 B2 * 12/2021 Darocha ..... E03C 1/0401
2019/0220046 A1 * 7/2019 Huang ..... G05D 23/1313

FOREIGN PATENT DOCUMENTS

CN 109185526 A * 1/2019
EP 0672228 B1 * 12/1998

* cited by examiner

*Primary Examiner* — Erin Deery

(57) ABSTRACT

The present utility model provides an easily-mounted pull-out faucet, including a faucet body, a faucet support bracket connected to the faucet body and a water supply assembly including a water supply hose. A lower end of the faucet body is connected with a mounting assembly. The mounting assembly includes a water supply pipe penetrated internally and a toothed pipe externally provided with a thread tooth. A quick connection assembly is sleeved around the toothed pipe, and the quick connection assembly is mated with the toothed pipe through the thread tooth in a screwed-down manner. The quick connection assembly further includes a fixing seat and a screwing-down mechanism, a fitting hook is disposed at a lower end of the fixing seat, and the fixing seat and the screwing-down mechanism are rotationally connected through the fitting hook.

7 Claims, 4 Drawing Sheets

30
31
20
10
40

EASILY-MOUNTED PULL-OUT FAUCET

CROSS-REFERENCE TO RELATED APPLICATION

The present application is based on, and claims priority from, Chinese application number CN202123197219.X, filed Dec. 17, 2021, the disclosure of which is hereby incorporated by reference herein in its entirety.

TECHNICAL FIELD

The present utility model relates to the field of kitchen pull-out faucets, and in particular to an easily-mounted pull-out faucet.

BACKGROUND

Typically, existing pull-out faucets are mounted and operated under a countertop of a sink, which may be inconvenient. In order to position a faucet body, including a cold water pipe and a hot water pipe inside the faucet body, on a countertop, an operator generally mounts and locks up a locking piece under the countertop. Due to limited space under the countertop and low visibility, the operator must perform the operations using small or special tools. During dismounting, tools are also needed to apply an external force, which may also be inconvenient and results in excessive consumption of time and labor. In this case, working efficiency is greatly decreased, costs are increased, and repair and replacement may be difficult. An object of the present utility model is to provide an easily-mounted pull-out faucet so as to solve the problems described above.

SUMMARY

In order to achieve the above purpose, the present utility model provides the following technical solution.

There is provided an easily-mounted pull-out faucet, including a faucet body, a faucet support bracket connected to the faucet body and a water supply assembly including a water supply hose. A lower end of the faucet body is connected with a mounting assembly. The mounting assembly further includes a water supply pipe penetrated internally and a toothed pipe externally provided with a thread tooth. A quick connection assembly is sleeved around the toothed pipe, and the quick connection assembly is mated with the toothed pipe through the thread tooth in a screwed-down manner. The quick connection assembly further includes a fixing seat and a screwing-down mechanism, a fitting hook is disposed at a lower end of the fixing seat, and the fixing seat and the screwing-down mechanism are rotationally connected through the fitting hook.

As a preferred or optional implementation, a locating column with a thread tooth is disposed inside the screwing-down mechanism, an inner side surface of the fixing seat is an oblique surface, and the locating column is abutted against the oblique surface to be mated with the toothed pipe in a screwed-down manner.

As a preferred or optional implementation, a soft rubber washer is disposed on the top of the fixing seat.

As a preferred or optional implementation, the faucet support bracket is inserted into the faucet body and rotated around a center of the faucet body.

As a preferred or optional implementation, a thread hole is disposed in the faucet body and the faucet support bracket is mated with the faucet body through a screw.

As a preferred or optional implementation, a circular groove is disposed at a lower portion of the faucet support bracket and the screw may be rotated into the groove.

As a preferred or optional implementation, a water supply connector is disposed inside the faucet support bracket, and the water supply hose is sleeved around the water supply connector.

Compared with the prior arts, the present utility model has the following beneficial effects.

(1) In the present utility model, all water supply pipes under the countertop of a sink are penetrated through the toothed pipe and the quick connection assembly is sleeved around the toothed pipe. When the pull-out faucet is to be fixed under a countertop, the quick connection assembly is pushed upward along the toothed pipe and hence screwed down through the thread tooth. When the pull-out faucet is to be dismounted, the quick connection assembly is unscrewed and pulled downward. Therefore, the mounting and dismounting both can be achieved without using the external force of tools. Even in a case of low visibility, the operations can be still completed easily, saving time and labor, increasing working efficiency and facilitating repair and replacement.

(2) The faucet support bracket is inserted into the faucet body and locked up with a screw, so as to prevent swing of the faucet support bracket. If the faucet support bracket is to be replaced, it is only required to loosen the screw so as to take out the support bracket. In addition to simple dismounting and replacement, the faucet support bracket can also rotate 360 degrees around a center of the faucet body. When the faucet support bracket rotates, the water supply pipe may rotate flexibly. When the pull-out faucet is unused, the faucet support bracket can be rotated to contact with a wall to increase a space of the sink, thus bringing comfortable, flexible and convenient experiences to operators.

BRIEF DESCRIPTIONS OF THE DRAWINGS

Numerals of the Drawings are Described Below:

10-faucet body;

20-faucet support bracket, 21-groove, 22-water supply connector;

30-water supply assembly, 31-water supply hose;

40-mounting assembly, 41-toothed pipe, 42-quick connection assembly, 421-fixing seat, 422-screwing-down mechanism, 4211-fitting hook, 4212-oblique surface, 4213-soft rubber washer, 4221-locating column;

50-screw.

DETAILED DESCRIPTIONS OF EMBODIMENTS

The technical solution of the embodiments of the present utility model will be clearly and fully described below in combination with accompanying drawings in the embodiments of the present utility model. Apparently, the described embodiments are merely some embodiments of the present utility model rather than all embodiments. Other embodiments obtained by those skilled in the art based on these embodiments of the present utility model without making creative work shall fall within the scope of protection of the present utility model.

Figure 1:
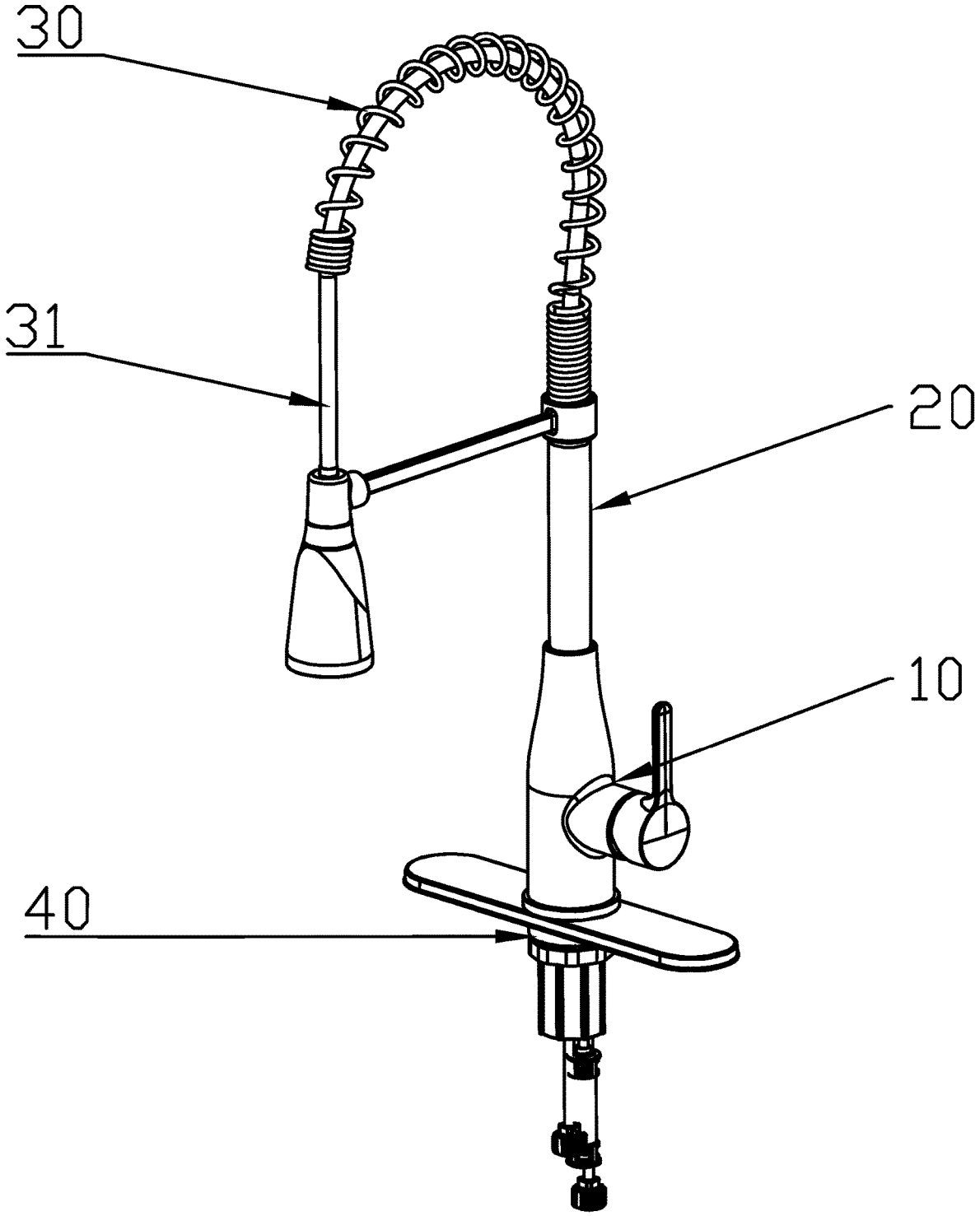
FIG. 1 is a schematic diagram illustrating a entire structure of the present utility mode.

As shown in FIG. 1, according to a preferred embodiment of the present utility model, there is provided an easily-mounted pull-out faucet, including a faucet body 10, a faucet support bracket 20 inserted into the faucet body 10, and a water supply assembly 30. The water supply assembly 30 includes a water supply hose 31 and a water outflow pull head (not shown). A mounting assembly 40 for fixing the faucet body 10 is connected at a lower end of the faucet body 10. The mounting assembly 40 includes a decorative panel on a countertop of a sink (not shown), a base panel (not shown), and a toothed pipe 41 penetrating through the countertop of the sink. The toothed pipe 41 is internally provided with cold and hot water pipes in an insertion manner and externally provided with a thread tooth. Under the countertop of the sink, a quick connection assembly 42 is sleeved on the toothed pipe 41 through the thread tooth.

Figure 2:
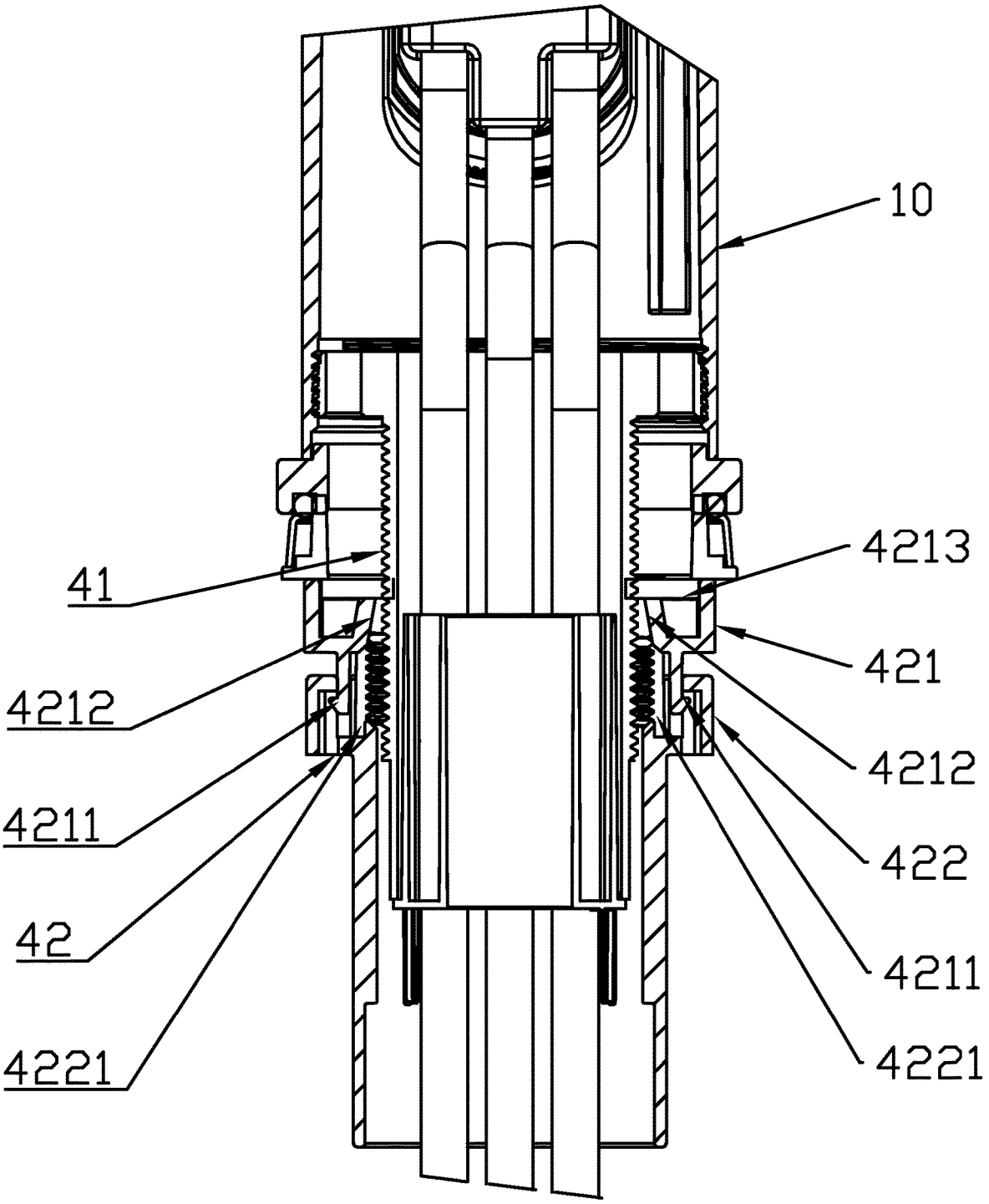
FIG. 2 is a sectional schematic diagram illustrating a pull-out faucet in a mounted state according to a preferred embodiment of the present utility model.
Figure 3:
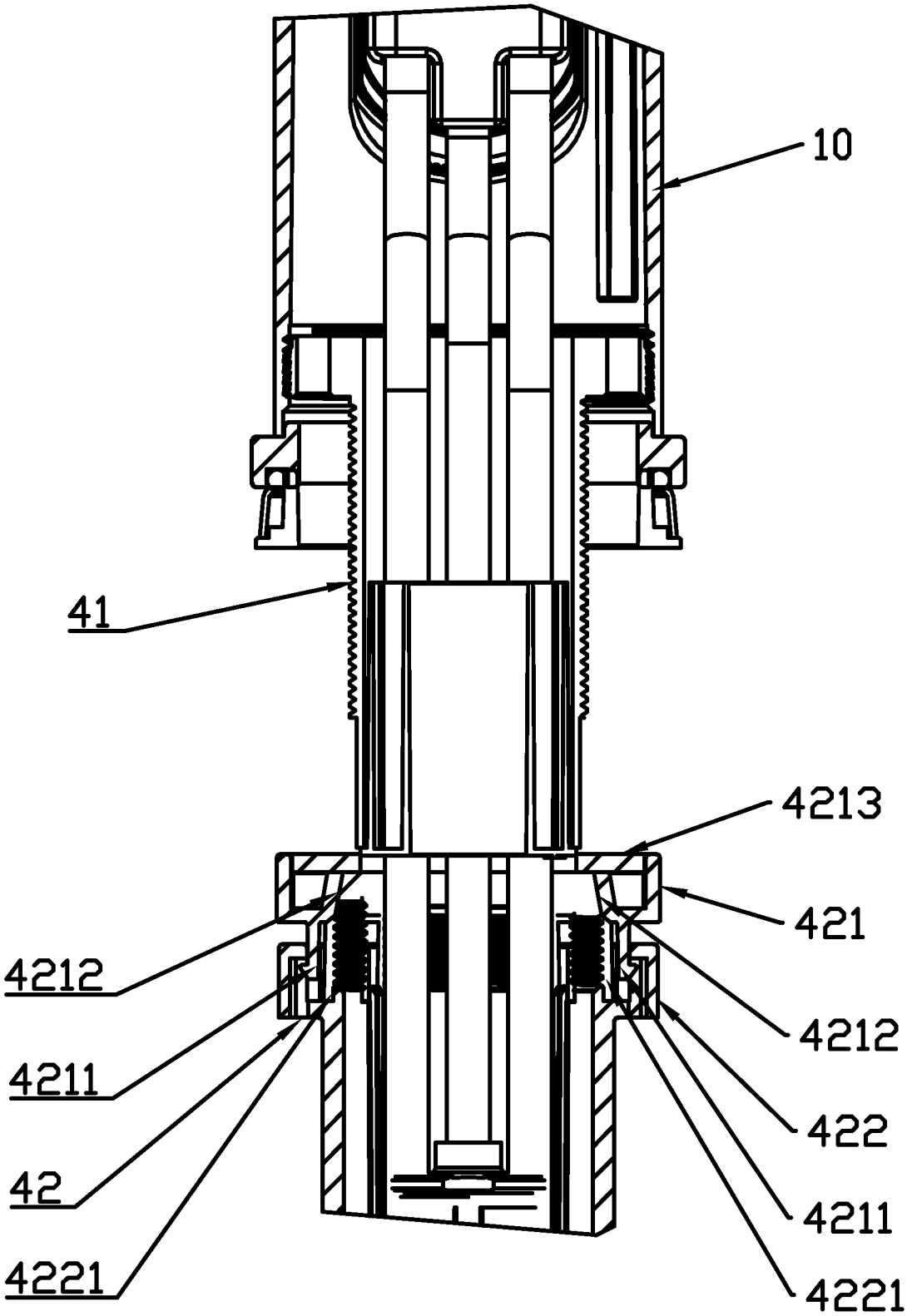
FIG. 3 is a sectional schematic diagram illustrating a pull-out faucet in a dismounted state according to a preferred embodiment of the present utility model.

As shown in FIGS. 2 and 3, the quick connection assembly 42 includes a fixing seat 421 and a screwing-down mechanism 422, both of which are sleeved around the toothed pipe 41. The top of the fixing seat 421 may be closely abutted against a lower bottom of the countertop of the sink through a soft rubber washer 4213 and an annular fitting hook 4211 also extends downwardly from the fixing seat 421. Because an annular locating column 4221 with a thread tooth extends upward along a central axis inside the screwing-down mechanism 422, the screwing-down mechanism 422 can be moved up and down rotationally on the toothed pipe 41 by engagement with the toothed pipe 41 through the thread tooth. When the screwing-down mechanism 422 moves down rotationally, the screwing-down mechanism 422 will be finally abutted against the fitting hook 4211 of the fixing seat 421, thereby ensuring entire mating of the quick connection assembly 42.

Specifically, when fixing the pull-out faucet on the countertop of the sink is required, the decorative panel (not shown) and the base panel (not shown) are firstly placed on a countertop hole of the sink, and then the toothed pipe 41 is penetrated through the countertop hole of the countertop of the sink. At this time, the water supply pipe is penetrated through the toothed pipe 41, and then the quick connection assembly 42 is sleeved around the toothed pipe 41, the fixing seat 421 is abutted against the lower bottom of the countertop of the sink, and the screwing-down mechanism 422 is rotationally pushed upward around the toothed pipe 41.

Furthermore, an inner side surface of the fixing seat 421 facing toward the toothed pipe 41 is an oblique surface 4212. When the screwing-down mechanism 422 is pushed upward rotationally around the toothed pipe 41, the locating column 4221 is abutted against the oblique surface 4212 under the resistance of the oblique surface 4212. Since the locating column 4221 is made of a deformable plastic material, under the resistance of the oblique surface 4212, the locating column 4221 is deformed and displaced toward the toothed pipe 41. Because a distance between the oblique surface 4212 of the fixing seat 421 and the toothed pipe 41 gradually decreases, the locating column 4221 and the thread tooth of the toothed pipe 41 are mated more closely. Therefore, the locating column 4221 is gradually fixed between the oblique surface 4212 and the toothed pipe 41, thus achieving locked mating between the quick connection assembly 42 and the toothed pipe 41.

With reference to FIG. 3, when required to dismount the pull-out faucet from the countertop of the sink, the screwing-down mechanism 422 may be unscrewed from the toothed pipe 41 and pulled downward, thus disengaging the locating column 4221 from between the oblique surface 4212 and the toothed pipe 41. In this way, the quick connection assembly 42 is entirely and downwardly removed along the toothed pipe 41 and then other corresponding components are dismounted.

The mounting and dismounting of the above pull-out faucet can be completed by hand without using any external force of tools. Even in a case of low visibility, the operations can be still completed through feel of hand, saving time and labor, greatly increasing the working efficiency and facilitating routine repair and replacement.

Figure 4:
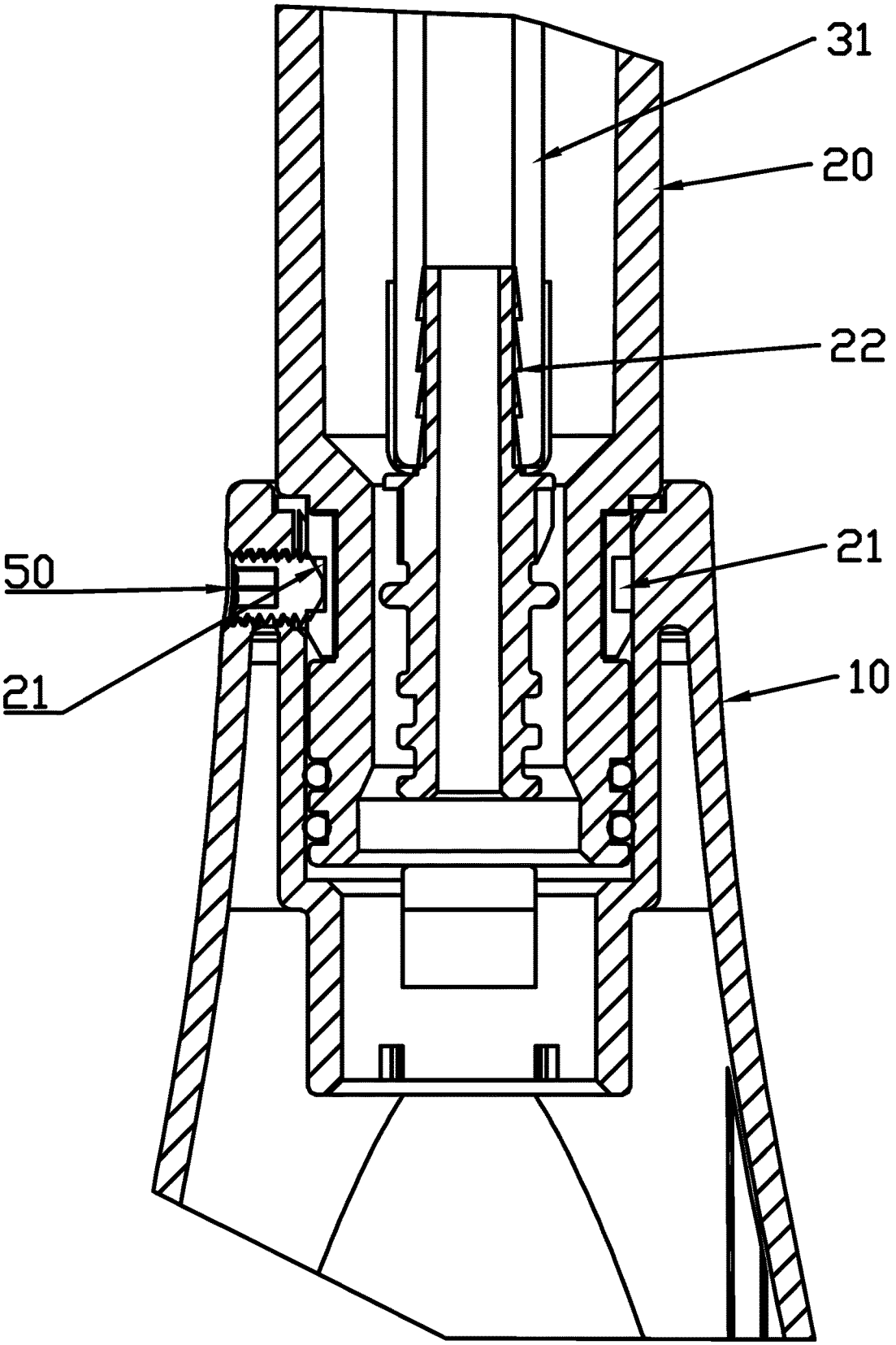
FIG. 4 is a sectional schematic diagram illustrating a faucet support bracket inserted into a faucet body according to a preferred embodiment of the present utility model.

With reference to FIG. 4, in order to easily mount the faucet support bracket 20 on the faucet body 10, the faucet support bracket 20 is directly inserted into the faucet body 10 in the solution of the present utility model.

Specifically, a thread hole is disposed in the faucet body 10, and a circular groove 21 is disposed at a lower portion of the faucet support bracket 20. When the faucet support bracket 20 is directly inserted into the faucet body 10, a screw 50 may be rotated into the groove 21 through the thread hole to prevent horizontal swing of the faucet support bracket 20. In this way, mated mounting of the faucet support bracket 20 and the faucet body 10 is achieved. If it is required to replace the faucet support bracket 20, the faucet support bracket 20 can be taken out simply by loosening the screw. Due to limited frictional resistance between the screw 50 and the groove 21, the faucet support bracket 20 may also rotate 360 degrees around a center of the faucet body 10. When the faucet support bracket 20 rotates, the water supply pipe 31 can be brought to rotate flexibly. When the pull-out faucet is unsused, the faucet support bracket 20 can be rotated to contact with a wall to increase a space of the sink, thus bringing comfortable, flexible and convenient experiences to operators.

Although the embodiments of the present utility model have been illustrated and described, those skilled in the art may understand that multiple changes, modifications, replacements and variations may be made to these embodiments without departing from the principle and spirit of the present utility model. The scope of protection of the present utility model is defined by the appended claims and its equivalents.

What is claimed is:

1. A pull-out faucet for a sink, comprising;

a faucet body, a faucet support bracket connected to the faucet body;

a water supply assembly including a water supply hose, and a lower end of the faucet body being connected with the mounting assembly;

a mounting assembly comprising a toothed pipe penetrating through a countertop of the sink, wherein the toothed pipe is internally provided with cold and hot water pipes and externally provided with a thread tooth; and under the countertop of the sink; and a quick connection assembly that is sleeved around the toothed pipe, wherein the quick connection assembly is mated with the toothed pipe through the thread tooth in a screwed-down manner; wherein the quick connection assembly further comprises a fixing seat and a screwing-down mechanism, both of which are sleeved around the toothed pipe; an annual fitting hook is disposed at a lower end of the fixing seat, and the fixing seat and the screwing-down mechanism are rotationally connected through the fitting hook; the top of the fixing seat is abutted against a lower bottom of the countertop of the sink through a rubber washer and the annular fitting hook also extends downwardly from the fixing seat; an annular locating column with a thread tooth extends upward along a central axis inside the screwing-down mechanism, and the screwing-down mechanism is configured to moved up and down rotationally on the toothed pipe by engagement with the toothed pipe through the thread tooth; wherein as the screwing-down mechanism moves down rotationally, the screwing-down mechanism will be abutted against the fitting hook of the fixing seat, thereby ensuring entire mating of the quick connection assembly;

an inner side surface of the fixing seat facing toward the toothed pipe is an oblique surface; when the screwing-down mechanism is pushed upward rotationally around the toothed pipe, the locating column is abutted against the oblique surface under the resistance of the oblique surface; the locating column is made of a deformable plastic material, under the resistance of the oblique surface, the locating column is deformed and displaced toward the toothed pipe; as a distance between the oblique surface of the fixing seat and the toothed pipe gradually decreases, the locating column and the thread tooth of the toothed pipe are mated; the locating column is fixed between the oblique surface and the toothed pipe, thus achieving locked mating between the quick connection assembly and the toothed pipe; and the screwing-down mechanism is configured to be unscrewed from the toothed pipe and pulled downward to dismount the pull-out faucet from the countertop of the sink, thus disengaging the locating column from between the oblique surface- and the toothed pipe; the quick connection assembly is entirely and downwardly removed along the toothed pipe and then the faucet body, the faucet support bracket, the water supply assembly and the mounting assembly are dismounted.

2. The pull-out faucet of claim 1, wherein the locating column with thea thread tooth is disposed inside the screwing-down mechanism, and the locating column is abutted against the oblique surface to be mated with the toothed pipe in the screwed-down manner.

3. The pull-out faucet of claim 2, wherein the rubber washer is disposed on the top of the fixing seat.

4. The pull-out faucet of claim 1, wherein the faucet support bracket is inserted in the faucet body and rotatable around a center thereof.

5. The pull-out faucet of claim 4, wherein a thread hole is disposed in the faucet body and the faucet support bracket is mated with the faucet body through a screw.

6. The pull-out faucet of claim 5, wherein a circular groove is disposed at a lower portion of the faucet support bracket and the screw is configured to be rotated into the groove; when the faucet support bracket is directly inserted into the faucet body, a screw is configured to be rotated into the groove through the thread hole to prevent horizontal swing of the faucet support bracket; mated mounting of the faucet support bracket and the faucet body is achieved; the faucet support bracket is configured to be taken out by loosening the screw to replace the faucet support bracket; the faucet support bracket is configured to rotate 360 degrees around a center of the faucet body; when the faucet support bracket rotates, the water supply pipe is brought to rotate; and when the pull-out faucet is unused, the faucet support bracket is rotated to contact with a wall to increase a space of the sink.

7. The pull-out faucet of claim 6, wherein a water supply connector is disposed inside the faucet support bracket, and the water supply hose is sleeved around the water supply connector.

* * * * *